US006857267B2

(12) United States Patent
Yamagiri et al.

(10) Patent No.: US 6,857,267 B2
(45) Date of Patent: Feb. 22, 2005

(54) STIRLING CYCLE ENGINE

(75) Inventors: Tsuneo Yamagiri, Niigata-ken (JP); Takashi Takahashi, Niigata-ken (JP); Hideto Urasawa, Niigata-ken (JP)

(73) Assignee: Twinbird Corporation (JP)

( * ) Notice: Subject to any disclaimer, the term of this patent is extended or adjusted under 35 U.S.C. 154(b) by 0 days.

(21) Appl. No.: 10/781,379

(22) Filed: Feb. 18, 2004

(65) Prior Publication Data

US 2004/0163388 A1 Aug. 26, 2004

(30) Foreign Application Priority Data

Feb. 19, 2003 (JP) ..... 2003-041718

(51) Int. Cl.[7] ..... F01B 29/10
(52) U.S. Cl. ..... 60/520; 60/524; 60/526
(58) Field of Search ..... 60/517, 520, 524, 60/526

(56) References Cited

U.S. PATENT DOCUMENTS 5,522,214 A * 6/1996 Beckett et al. ..... 60/517
5,920,133 A * 7/1999 Penswick et al. ..... 310/17
6,510,689 B2 * 1/2003 Budliger ..... 60/517
2002/0121816 A1 * 9/2002 Qiu et al. ..... 310/51

FOREIGN PATENT DOCUMENTS

JP 2001 355513 A 12/2001

* cited by examiner

*Primary Examiner*—Hoang Nguyen
(74) *Attorney, Agent, or Firm*—Akerman Senterfitt

(57) ABSTRACT

The Stirling cycle engine includes: a casing having a cylindrical shape; a cylinder for sidably inserting a displacer and a piston into a part adjacent to one end and another part adjacent to an other end thereof respectively, the cylinder being coaxially placed inside the casing; a driving mechanism provided around an outer peripheral surface of the cylinder so as to force the piston to reciprocate inside the cylinder; a mount for fixing the driving mechanism to the outer peripheral surface of the cylinder, the mount being integrally formed with the cylinder; a flat spring having a center portion thereof connected to the piston; and a plurality of connecting arms, one ends thereof being integrally formed with the mount and the other ends thereof being connected to a peripheral portion of the flat spring. Since the cylinder, the mounts and the connecting arms are integrally formed with one another, precisions or accuracies such as alignment accuracy of the displacer or the piston relative to the cylinder, can be improved.

11 Claims, 3 Drawing Sheets

STIRLING CYCLE ENGINE

BACKGROUND OF THE INVENTION

1. Field of the Invention

The present invention relates to a free-piston type Stirling cycle engine.

2. Description of the Related Art

An example of a conventional Stirling cycle engine of this type is disclosed in Japanese Patent Unexamined Publication No. 2001-355513. The disclosed Stirling cycle engine has a piston and a displacer slidably inserted into a cylinder provided within a casing, the piston being reciprocated by a driving mechanism. When the piston is operated by the driving mechanism so that it travels in the cylinder and comes close to the displacer, a gas, which is in a compression chamber provided between the piston and the displacer, is compressed and flows into an expansion chamber provided between a distal end of the displacer and a distal portion of the casing, through a heat dissipating fin, a regenerator and a heat absorbing fin. Accordingly, the displacer is pushed downwardly with a predetermined phase difference relative to the piston. On the other hand, when the piston travels in the cylinder away from the displacer, the inside of the compression chamber is subjected to negative pressure, and the gas in the expansion chamber flows back to the compression chamber through the heat absorbing fin, the regenerator and the heat dissipating fin. Accordingly, the displacer is pressed upwardly with the predetermined phase difference relative to the piston. Throughout these processes, a reversible cycle consisting of two changes: an isothermal change; and an isochoric change is carried out, and thus a part adjacent to the expansion chamber is brought into a low-temperature state and a part adjacent to the compression chamber is brought into a high-temperature state. The Stirling cycle engine also has spiral blade springs to control the operation of the piston and the displacer. Center portions of respective blade springs are connected to the piston and the displacer, while edges of the respective blade springs are fixed to a flange-shaped mount provided on an outer peripheral surface of the cylinder by a connecting arm. This mount fixes the cylinder to the casing, while the cylinder supports the driving mechanism. Meanwhile, the above publication also discloses a method for forming the above-described cylinder having the mount. The method roughly shapes the cylinder by forging and casting, and then cuts it by machining, forming the connecting arm in a long screw shape so as to be screwed to the mount.

The above-described Stirling cycle engine, however, has following problems when the mount and the connecting arm are combined together by a connecting means because these components are separated pieces. That is, it requires production equipment such as mould for producing the mount and the connecting arm individually, as well as respective assembling processes for these components. Thus production costs are relatively high. Besides, the accuracy of the Stirling cycle engine as a whole depends on the accuracy of the respective components and the accuracy of individual assembling process. This makes it difficult to improve the accuracy of the Stirling cycle engine as a whole. For example, in a case where the aligning adjustment of the piston to the displacer is difficult, the Stirling engine may not be assembled at the worst. Further, according to the above-mentioned conventional art aiming at easily producing the cylinder and the mount at low costs, the improvement of the accuracy in the conventional Stirling cycle engine would become more difficult because the accuracy in assembling these cylinder and mount also is required.

SUMMARY OF THE INVENTION

The present invention has been made to solve the above problems. It is, therefore, an object of the present invention to provide a Stirling cycle engine which can improve precisions relative to components thereof such as a cylinder, a mount and a connecting arm.

Another object thereof is to provide a Stirling cycle engine which can reduce production costs.

In order to attain the above objects, according to a first aspect of the present invention, there is provided a Stirling cycle engine comprising: a casing having cylindrical shape; a cylinder made from metal, the cylinder being coaxially inserted into the casing; a displacer slidably inserted into the inside of the cylinder adjacent to a distal end thereof, a piston sidably inserted into the inside of the cylinder adjacent to a proximal end thereof; a driving mechanism for reciprocating the piston, the driving mechanism being provided around an outer periphery of the cylinder adjacent to the proximal end thereof; a plurality of mounts for fixing the cylinder within the casing and supporting the driving mechanism, the plurality of mounts being provided on an outer periphery of the cylinder between the proximal and the distal ends thereof; a first flat spring having center portion thereof connected to the piston; and a plurality of connecting arms, one ends thereof being connected to one of the mounts and the other ends thereof being attached to the first flat spring, wherein the cylinder, the plurality of mounts and the plurality of connecting arms are integrally formed with one another.

Since the cylinder, the plurality of mounts and the plurality of connecting arms are integrally formed with one another, alignment accuracies relative to these components can be improved.

Further, the plurality of connecting arms may have reinforcing ribs respectively.

Alternatively, the Stirling cycle engine may further comprise: a plurality of spacers attached to the other ends of the connecting arms respectively; a rod, having one end thereof connected to the displacer; and a second flat spring, having a center portion thereof connected to the other end of the rod; wherein peripheral portion of said first flat may be sandwiched and supported between the other ends of the plurality of connecting arms and one ends of the spacers, and peripheral portion of the second flat may be attached to the other ends of the spacers.

Either the other ends of said plurality of connecting arms or one ends of said spacers may have screws, and the others may have internal threads fitting to the screws.

The cylinder, the plurality of mounts and the plurality of connecting arms that are integrated one another may be made from an aluminum bulk.

The cylinder, the plurality of mounts and the plurality of connecting arms that are integrated one another may be formed by die casting.

In order to attain the above objects, according to a second aspect of the present invention, there is provided a Stirling cycle engine comprising: a cylinder for slidably inserting a piston and a displacer; a casing accommodating the cylinder, the casing having a cylindrical portion being communicated with the cylinder, said cylindrical portion allowing the displacer to freely slide therein; a plurality of mounts for fixing the cylinder within the casing and supporting a driving mechanism, the driving mechanism forcing the piston to reciprocate; a plurality of flat springs, center portions thereof being connected to the piston and the displacer via a connection means; and a plurality of connecting arms, one ends thereof being fixed to one of the plurality of mounts and the other ends thereof being connected to peripheral portion of the plurality of flat springs, the cylinder, the plurality of mounts and the plurality of connecting arms being integrally formed with one another.

The plurality of flat springs may comprise a first flat spring and a second flat spring, the other ends of the plurality of connecting arms may have spacers respectively, the spacer having one end and the other end and being attachable to the other ends of the plurality of connecting arms, peripheral portion of the first flat spring may be sandwiched and supported between the other ends of the plurality of connecting arms and one ends of the respective spacers, and peripheral portion of the second flat spring may be attached to the other ends of the spacers.

Surfaces of the other ends of the plurality of connecting arms may comprise a plane intersecting the axis of the cylinder at right angle, and the first and second flat springs may intersect the axis of the cylinder at right angle in order to absorb a force while equally distributing the force on one surface thereof entirely, the force being generated by reciprocating motions of the piston and the displacer.

The spacers may have hexagonal pillar shapes.

In order to attain the above objects, according to a third aspect of the present invention, there is provided a Stirling cycle engine comprising: a casing having a cylindrical shape; a cylinder for slidably inserting a displacer and a piston into a part adjacent to one end and another part adjacent to an other end thereof respectively, the cylinder being coaxially placed inside the casing; a driving mechanism provided around an outer peripheral surface of the cylinder, the driving mechanism forcing the piston to reciprocate inside the cylinder; a mount for fixing the driving mechanism to the outer peripheral surface of the cylinder, the mount being integrally formed with the cylinder; a flat spring having a center portion thereof connected to the piston; and a plurality of connecting arms, one ends thereof being integrally formed with the mount and the other ends thereof being connected to a peripheral portion of the flat spring.

BRIEF DESCRIPTION OF THE DRAWINGS

These objects and other objects and advantages of the present invention will become more apparent upon reading of the following detailed description and the accompanying drawings in which.

DETAILED DESCRIPTION OF THE PREFERRED EMBODIMENT

Figure 1:
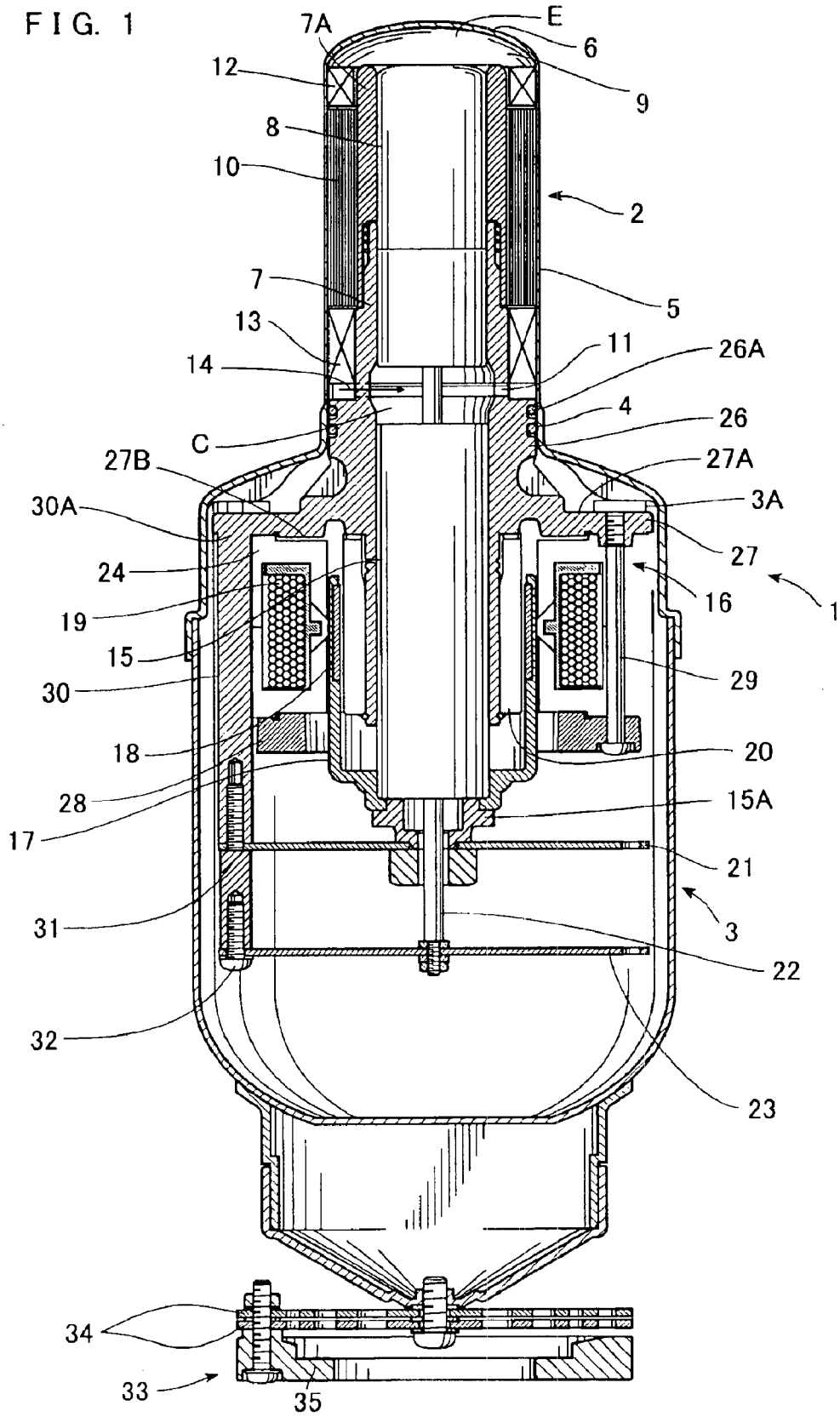
FIG. 1 is a cross sectional view showing the structure of a Stirling cycle engine according to an embodiment of the present invention.
Figure 2:
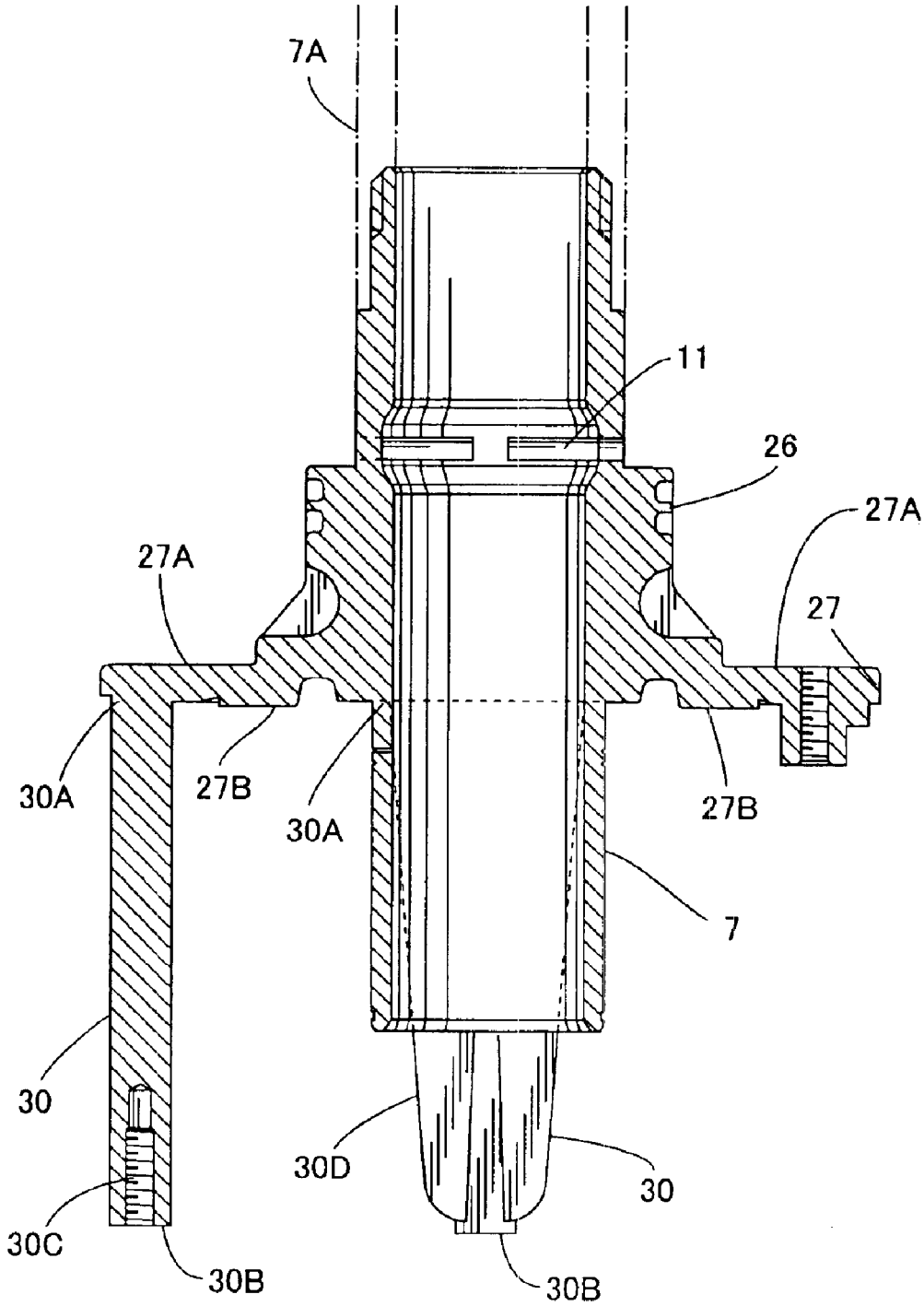
FIG. 2 is a cross sectional view showing the structure of a cylinder, mounts, and a connecting arm integrated with one another.
Figure 3:
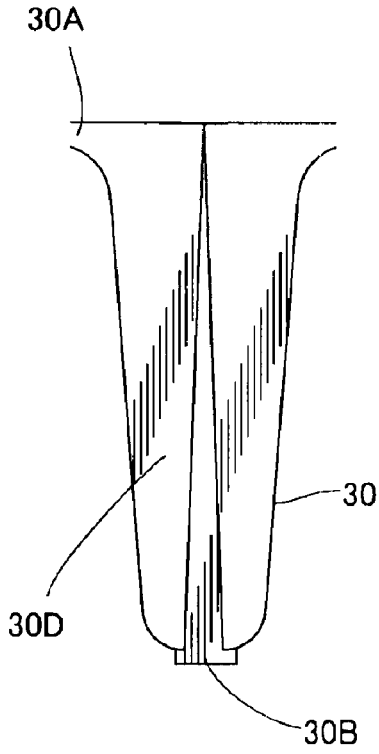
FIG. 3 is a front elevational view showing the connecting arm shown in FIG. 2.
Figure 4:
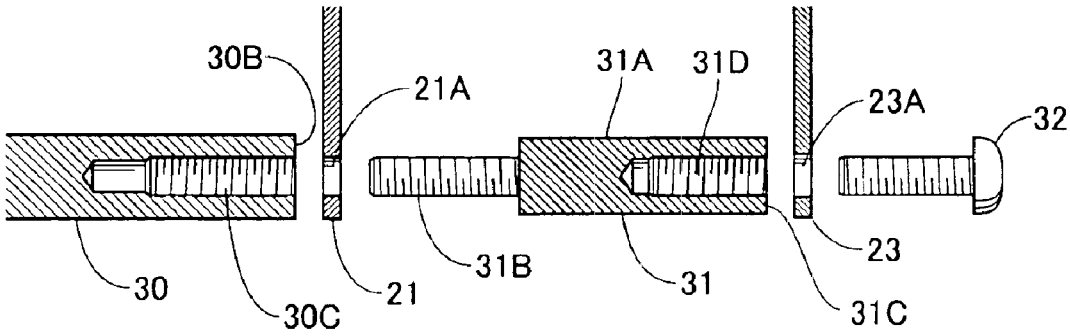
FIG. 4 is an exploded view for explaining the structure of the connecting arm shown in FIG. 2.

A preferred embodiment of the present invention will now be described in detail with reference to the accompanying drawings. As shown in FIGS. 1–3, a Stirling cycle engine according to this embodiment has a casing 1 comprising: a cylindrical portion 2; and a main body portion 3 having substantially cylindrical shape. The cylindrical portion 2 is made from, for example, stainless steel and comprises a proximal portion 4, an intermediate portion 5 and a distal portion 6 that are integrated with one another.

A cylinder 7 extending to inside the main body portion 3 is coaxially inserted into the cylindrical portion 2. An extended cylinder portion 7A that is a discrete portion is coaxially connected to a distal end of the cylinder 7 adjacent to the distal portion 6. The cylinder 7 is made from, for example, aluminum, the proximal end thereof adjacent to the main body portion 3 is integrally formed with mounts 26, 27 (described later) and a plurality of connecting arms 30 (also described later) by casting such as die casting or the like. An inner peripheral surface and an outer peripheral surface, etc. of the cylinder 7 are formed by cutting work after casting. A displacer 8 is sidably provided in the axial direction inside the extended cylinder portion 7A and that of the cylinder adjacent to the distal portion 6. An expansion chamber E is provided between a distal end of the displacer 8 and the distal portion 6 of the cylindrical portion 2. Inside and outside of the extended cylinder portion 7A are communicated via an aperture 9. In the intermediate portion 5, a regenerator 10 is provided between the inner peripheral surface of the cylindrical portion 2 and the outer peripheral surface of the cylinder 7, and in the proximal portion 4, a communication hole 11 for allowing the inside of the cylinder 7 to communicate with the outside thereof is formed on the cylinder 7. A heat absorbing fin 12 is provided between the inner circumference of the distal portion 6 included in the cylindrical portion 2 and the outer periphery of the distal end of the extended cylinder portion 7A, while a heat dissipating fin 13 is provided around the outer periphery of the cylinder 7, in a position between the regenerator 10 and the communication hole 11. A path 14 is formed so as to connect the distal end of the inside of the extended cylinder portion 7A to the compression chamber C through the aperture 9, the heat absorbing fin 12, the regenerator 10, the heat dissipating fin 13 and the communication hole 11. Further, a piston 15 is provided within the main body portion 3, on inside the proximal side of the cylinder 7 in a manner capable of sliding in the axial direction. The proximal portion of the piston 15 is coaxially connected to a driving mechanism 16. The driving mechanism 16 is connected to the proximal end of the piston 15 by a connecting member 15A, comprising: a short-cylindrical frame 17 having coaxially extensional form and provided on the outer periphery of the proximal side of the cylinder 7; a cylindrical permanent magnet 18 fixed to one end of the frame 17; a ring-shaped electromagnetic coil 19 provided adjacent to the outer periphery of the permanent magnets 18; and a magnetism introducing portion 20 provided adjacent to the inner periphery of the permanent magnet 18.

A first flat spring 21 for controlling the operation of the piston 15 is connected to the connecting member 15A which connects the piston 15 to the frame 17. To the proximal side of the displacer 8, one end of a rod 22 is connected for controlling the operation thereof. The other end of a rod 22 is connected to a second flat spring 23. Meanwhile, the rod 22 extends in a manner that it penetrates the piston 15. As illustrated, a pair of the flat springs 21, 23 is placed on an outer space adjacent to the proximal part of the cylinder 7 in the main body portion 3. The second flat spring 23 is placed in a position away from the proximal part of the cylinder 7 compared to a position where the first flat spring 21 is placed. The electromagnetic coil 19 is wound around a laminated core 24, while the laminated core 24 is integrated with the electromagnetic coil 19.

As shown in FIGS. 1 and 2, on the outer peripheral surface of the intermediate part of the cylinder 7, a mount 26 coaxially protruding is integrally formed with the cylinder 7, while on a position close to the cylinder 7 compared to the position where the mount 26 is placed, a flange-type mount 27 is integrally formed with the cylinder 7. These mounts 26, 27 are placed so as to have a predetermined interval. The mount 26 contacts the proximal portion 4 of the cylindrical portion 2 via at least one O-ring 26A and fixes the cylinder 7 to the cylindrical portion 2 of the casing 1. The mount 27 employs a structure such that one side surface 27A thereof contacts a mount portion 3A locating inside the main body portion 3. The mount 27 is fixed to the mount portion 3A by at least one screw. The other side surface 27B thereof contacts one end of the laminated core 24 constructing the driving mechanism 16. The other end of the laminated core 24 contacts a fixation ring 28. The fixation ring 28 and the mount 27 sandwiches and supports the laminated core 24 while a screw 29 fastening these. Accordingly, the laminated core 24 and the electromagnetic coil 19 integrated with the laminated core 24 are mounted onto the mount 27. A plurality of connecting arms 30 are provided on the other side surface 27B of the mount 27 so as to protrude therefrom along the axial direction of the cylinder 7. As shown in FIG. 2, the plurality of connecting arms 30 is integrally formed with the mount 27 via proximal ends 30A thereof. Distal end surfaces 30B thereof are formed such that it orthogonally crosses the axial direction of the cylinder 7 on the same plane. A screw hole 30C having an internal thread along the axial direction of the cylinder 7 is formed on each of the distal end surface 30B. Further, as shown in FIGS. 2 and 3, reinforcing ribs 30D having relatively thin wall are formed on the respective connecting arms 30 along the circumferential direction of the flange-shaped mount 27. Since the plurality of mounts 26, 27 and the plurality of connecting arms 30 are integrally formed with the cylinder 7 in this manner, precisions thereon are improved. Moreover, since the reinforcing ribs 30D are integrally formed with the connecting arms 30, the strength of the plurality of connecting arms 30 is also improved. Accordingly, a distortion of the connecting arms 30 that occurs during assembling is prevented, and thus a precision for assembling the Stirling cycle engine of this embodiment is indirectly improved.

The first flat spring 21 contacts the distal end surfaces 30B. The first flat spring 21 is sandwiched and supported between the connecting arms 30 and respective spacers 31 while contacting the distal end surfaces 30B. Each spacer 31 employs a structure such that its main body 31A has a hexagonal pillar shape, one end thereof has a screw 31B being coaxial relative to the main body 31A so as to fit in the internal thread 30C, the other end surface 31C thereof has a screw hole having an internal thread 31D and being coaxial relative to the main body 31A. By screwing the screws 31B attached to one end of the spacers 31 into the respective screw holes 30C of the connecting arms 30 via screw holes 21A formed on the outer peripheral part of the first flat spring 21, the first flat spring 21 is sandwiched between the connecting arms 30 and the spacers 31, thereby being supported therebetween. Since the spacers 31 have hexagonal pillar shapes, it is easy to attach the spacers 31 to the respective connecting arms 30 by tightening with a wrench or the like. Since the distal end surfaces 30B comprise a plane that intersects the axis of the cylinder 7 at right angle, the first flat spring 21 contacting the distal end surfaces 30B also intersects the axis of the cylinder 7 at right angle so as to equally distribute a force generated by the operation of the displacer 15 and the piston 8 on one surface thereof. Also, in a state where the spacers 31 are attached to the respective connecting arms 30, the other end surfaces 31C comprise a plane that intersects the axis of the cylinder 7 at right angle and the second flat spring 23 contacts the end surfaces 31C. The second flat spring 23 is fixed to the spacer 31 by fitting screws 32 into the internal thread of the screw holes 31D via the screw holes 23A formed on the outer periphery of the second flat spring 23 in a state where it contacts the other end surface 31C. The Stirling cycle engine of this embodiment employs a structure such that the first flat spring 21 is sandwiched by attaching the spacers 31 to the connecting arms 30, while the second flat spring 23 is attached to the spacers 31. This makes it easy to attach the discrete 1 flat springs 21 and 23 relative to the cylinder 7. Further, attaching the flat springs 21, 23 to the common connecting arms 30 by this means, a structure for fixing these components is simplified, and thus the Stirling cycle engine of this embodiment can be entirely downsized. Still further, by employing a structure such that the connecting arms 30 have screw holes 30C having internal threads on the distal end surfaces 30B, while the spacers 31 have screws 31B for fitting to the screw holes 30C, the first flat spring 21 and the second flat spring 23 can be fixed sequentially, and thus fixing these components is much easier than a conventional one.

Meanwhile, as shown in FIG. 1, the Stirling cycle engine of this embodiment further has a vibration absorbing unit 33. The vibration absorbing unit 33 comprises a plurality of flat springs 34 and a balance weight 35. The plurality of flat springs 34 and the balance weight 35 are coaxially arranged relative to the cylinder 7 such that the plurality of flat springs 34 stack on the balance weight 35 through a connecting portion arranged on the axis line of the cylinder 7.

In the above-explained Stirling cycle engine, the cylinder 7 is fixed with the mount 26 contacting the inside of the proximal portion 4 included in the cylindrical portion 2 via the O-ring 26A, and the one side surface 27A of the mount 27 contacting the mount portion 3A in the main body portion 3 and being fixed thereonto by screwing. Since the mount 26 contacts the inner surface of the cylindrical portion 2 via the O-ring 26A, the cylinder 7 can be arranged coaxial relative to the cylindrical portion 2. The cylinder 7 attaches the magnetism introducing portion 20 to the outer peripheral surface of the proximal side thereof, and fixes the electromagnetic coil 19 and laminated core 24 comprising the driving mechanism 16 to the mount 27 integrally formed with the cylinder 7 by the fixation ring 28 and the screw 29. The displacer 8 and the piston 15 are installed in the cylinder 7. The first flat spring 21 attached to the connecting member 15A adjacent to the proximal end of the piston 15 is sandwiched and supported between the connecting arms 30 and the spacers 31. The outer periphery of the second flat spring 23 that the center part thereof is connected to the other end of the rod 22 is fixed to the other ends of the spacers 31. The main body portion 3 and the cylindrical portion 2 are connected each other, and the pre-assembled vibration absorbing unit 33 is then attached to the main body portion 3.

Next, operations of the Stirling cycle engine employing the above-described structure will now be described. When an alternate current is applied to the electromagnetic coil 19, an alternate electromagnetic field is generated from the electromagnetic coil 19 and concentrated around the laminated core 24. A force for allowing the permanent magnet 18 to reciprocate along the axial direction of the cylinder 7 is then generated by the generated alternate electromagnetic field. Due to this, the piston 15 attached to the frame 17 that supports the permanent magnet 18 starts reciprocating in the cylinder 7 along its axial direction. When the piston 15 moves in the direction for coming close to the displacer 8, a gas within the compression chamber C locating in between the displacer 8 and the piston 15 is compressed. The compressed gas then flows into the expansion chamber E locating in between the distal end of the displacer 8 and the distal portion 6 of the cylindrical portion 2, through the communication hole 11, the heat dissipating fin 13, the regenerator 10, the heat absorbing fin 12 and the aperture 9. Accordingly, the displacer 8 is pressed downwardly with a predetermined phase difference relative to the piston 15. On the other hand, when the piston 15 moves in the direction for coming away from the displacer 8, the inside of the compression chamber C is negative-pressurized and the gas in the expansion chamber E flows back to the compression chamber C through the aperture 9, the heat absorbing fin 12, the regenerator 10, the heat dissipating fin 13 and communication hole 11. Accordingly, the displacer 8 is pressed upwardly with the predetermined phase difference. Throughout these processes, a reversible cycle consisting of two changes: an isothermal change; and an isovolumetric change is carried out, thus the adjacent part of the expansion chamber E is brought into a low-temperature state, while the compression chamber C is brought into a high-temperature state. When the displacer 8 and the piston 15 reciprocate, vibrations are generated. Most vibrations are absorbed by the vibration absorbing unit 33, but there might be a case that all of the vibrations are not dissipated. However, since the cylinder 7, the mount 27 and the connecting arm 30 are integrally formed with one another, loosening the connections of these three portions does not occur due to the remained vibrations. Therefore, the strengths and the precisions of these three portions are conserved. Further, as explained above, since the connecting arms 30 are reinforced by the reinforcing ribs 30D, a deformation due to the vibrations is essentially prevented. Therefore, the precision of the Stirling cycle engine is kept high while operating.

As explained above, the Stirling cycle engine of this embodiment has the cylinder 7, the plurality of mounts 26, 27 and the plurality of connecting arms 30 being integrated with one another. By employing this structure, the Stirling cycle engine can improve various kinds of precisions (accuracies) such as alignment accuracies of the displacer 8 and the piston 15 within the cylinder 7; the cylinder 7 and the cylindrical portion 2 positioned by the plurality of mounts 26, 27; positioning of the first flat spring 21 attached by the connecting arm 30; and so on. Since alignment accuracies of the components are improved, an efficiency of assembling the Stirling cycle engine during its assembling process is also improved. Therefore, a performance improvement of the Stirling cycle engine such as noise reduction can be obtained. Besides, by cutting and machining the cylinder 7, the plurality of mounts 26, 27 and the plurality of connecting arms 30 integrally formed with one another as a whole, the alignment accuracy of the plurality of mounts 26, 27 relative to the cylinder 7 can be improved. The shapes of the cylinder 7, the mounts 26, 27 and the connecting arms 30 can be freely changed by die casting. Further, producing equipments for producing the cylinder 7, the plurality of mounts 26, 27 and the connecting arms 30 individually are not necessary, production costs are reduced entirely.

In the Stirling cycle engine of this embodiment, the connecting arms 30 have reinforcing ribs 30D, thus the strengths of the connecting arms 30 are improved, the strength of attaching the first flat spring 21 and the alignment accuracy of attaching the first flat spring 21 is indirectly improved.

The present invention is not limited to the above embodiment. For example, whilst the screw holes having internal threads are formed on the distal end surfaces of the connecting arms and the screws are attached to one ends of the spacers in the above embodiment, the screw holes may be formed on one ends of the spacers and the screws may be attached to the distal end surfaces of the connecting arms.

Various embodiments and changes may be made thereonto without departing from the broad spirit and scope of the invention. The above-described embodiment is intended to illustrate the present invention, not to limit the scope of the present invention. The scope of the present invention is shown by the attached claims rather than the embodiments.

What is claimed is:

1. A Stirling cycle engine comprising:

a case having a cylindrical shape;

a cylinder made from metal, said cylinder being coaxially inserted into said casing;

a displacer slidably inserted into an inside of said cylinder adjacent to a distal end thereof;

a piston slidably inserted into the inside of said cylinder adjacent to a proximal end thereof;

a driving mechanism for reciprocating said piston, said driving mechanism being provided around an outer periphery of said cylinder adjacent to the proximal end thereof;

a plurality of mounts for fixing said cylinder within said casing and supporting said driving mechanism, said plurality of mounts being provided on the outer periphery of said cylinder between the proximal and the distal ends thereof;

a first flat spring having a center portion thereof connected to said piston; and a plurality of connecting arms, first ends thereof being connected to one of said mounts and the other ends thereof being attached to said first flat spring;

wherein said cylinder, said plurality of mounts and said plurality of connecting arms are integrally formed into a single piece by casting.

2. The Stirling cycle engine according to claim 1, wherein said plurality of connecting arms have reinforcing ribs.

3. The Stirling cycle engine according to claim 1, further comprising a plurality of spacers attached to the other ends of said connecting arms;

a rod, one end thereof being connected to said displacer; and a second flat spring having a center portion thereof connected to the other end of said rod;

wherein a peripheral portion of said first flat spring is sandwiched and supported between the other ends of said plurality of connecting arms and first ends of said spacers, while a peripheral portion of said second flat spring is attached to the other ends of said spacers.

4. The Stirling cycle engine according to claim 3, wherein either the other ends of said plurality of connecting arms or the first ends of said spacers have screws, and the others have internal threads fining to said screws.

5. The Stirling cycle engine according to claim 2, wherein said cylinder, said plurality of mounts and said plurality of connecting arms are made from an aluminum bulk.

6. The Stirling cycle engine according to claim 5, wherein said cylinder, said plurality of mounts and said plurality of connecting arms are formed by die casting.

7. A stirling cycle engine comprising:

a cylinder for slidably inserting a piston and a displacer;

a casing accommodating said cylinder, said casing having a cylindrical portion being communicated with said cylinder, said cylindrical portion allowing said displacer to freely slide therein;

a plurality of mounts for fixing said cylinder within said casing and supporting a driving mechanism, said driving mechanism forcing said piston reciprocate;

a plurality of flat springs having center portions thereof connected to said piston and said displacer via a connection means; and a plurality of connecting arms, first ends thereof being fixed to one of said plurality of mounts and the other ends thereof being connected to peripheral portions of said plurality of flat springs, wherein said cylinder, said plurality of mounts and said plurality of connecting arms are integrally formed into a single piece by casting.

8. The Stirling cycle engine according to claim 7, wherein:

said plurality of flat springs comprise a first flat spring and a second flat spring;

the other ends of said plurality of connecting arms have spacers, said spacers having first ends and other ends and are attachable to the other ends of said plurality of connecting arms;

peripheral portions of said first flat springs are sandwiched and supported between the other ends of said plurality of connecting arms and the first ends of said respective spacers; and peripheral portions of said second flat springs are attached to the other ends of said spacers.

9. The Stirling cycle engine according to claim 8, wherein:

surfaces of the other ends of said plurality of connecting arms comprise a plane intersecting the axis of said cylinder at a right angle; and said first and second flat springs intersect the axis of said cylinder at a right angle in order to absorb a force while equally distributing the force on one surface thereof entirely, the force being generated by reciprocating motions of said piston and said displacer.

10. The Stirling cycle engine according to claim 8, wherein said spacers have hexagonal pillar shapes.

11. A Stirling cycle engine comprising:

a casing having a cylindrical shape;

a cylinder made from metal, said cylinder being coaxially inserted into said casing;

a displacer slidable inserted into the inside of said cylinder adjacent to distal end thereof;

a piston slidably inserted into the inside of said cylinder adjacent in a proximal end thereof;

a driving mechanism for reciprocating said piston, said driving mechanism being provided around an outer periphery of said cylinder adjacent to the proximal end thereof;

a plurality of mounts for fixing said cylinder within said casing and supporting said driving mechanism, said plurality of mounts being provided on the outer periphery of said cylinder between the proximal and the distal ends thereof;

a flat spring having a center portion thereof connected to said piston; and a plurality of connecting arms, first ends thereof being connected to one of said mounts and the other ends thereof being to said flat spring, wherein;

said cylinder, said plurality of mounts and said plurality of connecting arms are integrally formed in a single piece; and said driving mechanism is formed in a shape so as to avoid a contact with said plurality of connecting arms.

* * * * *

UNITED STATES PATENT AND TRADEMARK OFFICE

CERTIFICATE OF CORRECTION

PATENT NO. : 6,857,267 B2
APPLICATION NO. : 10/781379
DATED : February 22, 2005
INVENTOR(S) : Yamagiri et al.

It is certified that error appears in the above-identified patent and that said Letters Patent is hereby corrected as shown below:

Title page, column 2, in the Abstract:
line 2, replace “sidably” with --slidably--
line 4, replace “an other” with --another--
line 4, replace “respectively,_the” with --respectively, the--

Column 3, line 33, replace “an other” with --another--

Column 4, line 19, replace “sidably” with --slidably--

Column 8, line 64, replace “fining” with --fitting--

Column 9, line 12, replace “piston reciprocate” with --piston to reciprocate--

Column 10, line 16, replace “to distal” with --to a distal--

Column 10, line 18, replace “in a proximal” with --to a proximal--

Column 10, line 32, replace “being to said flat” with --being connected to said flat--

Signed and Sealed this

Eighteenth Day of July, 2006

JON W. DUDAS
*Director of the United States Patent and Trademark Office*